US010441954B2

(12) United States Patent
Vuorio et al.

(10) Patent No.: US 10,441,954 B2
(45) Date of Patent: Oct. 15, 2019

(54) SINGLE-DISC REFINER

(71) Applicants: Valmet Technologies, Inc., Espoo (FI); UPM-Kymmene Corporation, Helsinki (FI)

(72) Inventors: Petteri Vuorio, Espoo (FI); Jari Saarinen, Jämsä (FI); Jari Heikkinen, Lappeenranta (FI); Lauri Talikka, Lappeenranta (FI)

(73) Assignee: VALMET TECHNOLOGIES OY, Espoo (FI)

( * ) Notice: Subject to any disclaimer, the term of this patent is extended or adjusted under 35 U.S.C. 154(b) by 826 days.

(21) Appl. No.: 14/751,020

(22) Filed: Jun. 25, 2015

(65) Prior Publication Data

US 2015/0375231 A1 Dec. 31, 2015

(30) Foreign Application Priority Data

Jun. 26, 2014 (FI) ..... 20145620

(51) Int. Cl.

| | |
|---|---|
| ***B02C 7/12*** | (2006.01) |
| ***D21D 1/30*** | (2006.01) |
| ***B02C 7/04*** | (2006.01) |

(52) U.S. Cl.

CPC ..... *B02C 7/12* (2013.01); *B02C 7/04* (2013.01); *D21D 1/30* (2013.01); *D21D 1/306* (2013.01)

(58) Field of Classification Search

CPC .... B02C 7/00; B02C 7/12; B02C 7/04; D21D 1/30; D21D 1/303; D21D 1/306

(Continued)

(56) References Cited

U.S. PATENT DOCUMENTS 3,387,796 A 6/1968 Cormack et al.
3,473,745 A 10/1969 Shook, Jr. et al.

(Continued)

FOREIGN PATENT DOCUMENTS

DE 102008039003 A1 2/2010
EP 0611599 A1 8/1994

(Continued)

OTHER PUBLICATIONS

Dictionary.com definition of "defibrate", Printed on Feb. 20, 2018.*

(Continued)

*Primary Examiner* — Shelley M Self
*Assistant Examiner* — Jared O Brown
(74) *Attorney, Agent, or Firm* — Stiennon & Stiennon

(57) ABSTRACT

A single-disc refiner (1) has a stationary refining element (2) and an opposed rotatable refining element (12), each of which has a radially inner blade element (4, 14) providing an inner refining surface area and a radially outer blade element providing an outer refining surface area. The inner and outer refining surface areas of each refining element together provide a refining surface of the refining element, the refining surfaces defining a feed zone (29) followed by a treatment zone (30) with a transition point therebetween located at a radial distance of 70-90% from the center of the refiner or at a radial distance of 50-80% from the innermost edge (25, 27) of the refining element or at a radial distance of 20-50% from the inner edge (34) of the outer blade element (8, 18, 33) towards the outermost edge (26, 28, 35) of the refining element.

6 Claims, 2 Drawing Sheets

(58) Field of Classification Search
USPC ..... 241/261.2, 261.3
See application file for complete search history.

(56) References Cited

U.S. PATENT DOCUMENTS

| | | | | |
|---|---|---|---|---|
| 3,552,664 | A | 1/1971 | Herbert et al. | |
| 3,910,511 | A * | 10/1975 | Leider | B02C 7/06 241/261.3 |
| 3,974,971 | A | 8/1976 | Reinhall | |
| 5,181,664 | A | 1/1993 | Kohler | |
| 5,383,617 | A | 1/1995 | Deuchars | |
| 5,683,048 | A | 11/1997 | Virving | |
| 6,402,071 | B1 * | 6/2002 | Gingras | B02C 7/12 241/261.2 |
| 7,322,539 | B2 * | 1/2008 | Huhtanen | B02C 7/12 241/261.3 |
| 2004/0118959 | A1 * | 6/2004 | Virving | B02C 7/02 241/261.3 |
| 2004/0128817 | A1 | 7/2004 | Lange | |
| 2005/0211809 | A1 * | 9/2005 | Lutz | B02C 7/11 241/261.2 |
| 2006/0006264 | A1 * | 1/2006 | Sabourin | B02C 7/12 241/261.2 |
| 2007/0029423 | A1 * | 2/2007 | Sanagi | B02C 7/08 241/261.2 |
| 2007/0210197 | A1 | 9/2007 | Carpenter | |
| 2009/0145990 | A1 * | 6/2009 | Vuorio | D21D 1/306 241/261.3 |
| 2011/0024540 | A1 * | 2/2011 | Vihma | C22C 38/02 241/293 |
| 2013/0270377 | A1 * | 10/2013 | Gingras | D21B 1/26 241/220 |
| 2014/0077016 | A1 * | 3/2014 | Gingras | D21D 1/306 241/298 |
| 2014/0110512 | A1 * | 4/2014 | Lee | B02C 7/12 241/30 |

FOREIGN PATENT DOCUMENTS

| | | | |
|---|---|---|---|
| EP | 2650432 | A1 | 10/2013 |
| WO | 9525199 | A1 | 9/1995 |
| WO | 2013010073 | A1 | 1/2013 |

OTHER PUBLICATIONS

Dictionary.com definition of "refine", Printed on Feb. 20, 2018.*
European Search Report for EP15173287 dated Oct. 22, 2015.
Search Report for FI20145620 dated Feb. 12, 2015.

* cited by examiner

SINGLE-DISC REFINER

CROSS REFERENCES TO RELATED APPLICATIONS

This application claims priority on Finnish application FI 20145620, filed Jun. 26, 2014, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a single-disc refiner for refining lignocellulosic material for paper and board manufacturing, comprising a stationary refining element and an opposed rotatable refining element, the stationary and rotatable refining elements each comprising at least one radially inner blade element providing an inner refining surface area of the refining element and at least one radially outer blade element providing an outer refining surface area of the refining element, the inner refining surface area and the outer refining surface area of each refining element together providing a refining surface of the refining element.

The present invention also relates to a blade element for a rotatable disc-like refining element of a refiner, the blade element being intended to provide at least part of a refining surface of the rotatable disc-like refining element and comprising an inner edge to be directed toward the center of the refining element and an outer edge to be directed toward the outermost edge of the refining element and a refining surface provided with blade bars and blade grooves therebetween.

Flat disc refiners for refining fibrous material for manufacturing paper and board typically comprise at least two opposite disc-like refining elements, at least one of which is rotating. A refining gap is provided between the two opposite elements. In so-called DD or double-disc refiners, both refining elements rotate in opposite directions, whereas in SD or single-disc refiners only one refining element rotates. A so-called Twin refiner is also a single-disc refiner comprising three refining elements, one of which is a rotatable element sandwiched between two stationary elements, whereby two refining gaps are provided.

Single-disc high-consistency refiners for wood chips and fibres comprise a stationary disc-like refining element and an opposed rotatable disc-like refining element, and have a blade gap or a refining gap therebetween, a suspension of water and wood chips to be refined being fed into the blade gap. In most single-disc high-consistency refiners the stationary and rotatable refining elements comprise an annular inner refining surface area and an annular outer refining surface area composed of one or more blade elements, whereby the inner refining surface area and the outer refining surface area of each refining element together provide a complete refining surface of the refining element.

Single-disc high-consistency wood chip refiners have a simple structure and operation. However, single-disc refiners typically operate with an undesirable high energy consumption and a low production capacity.

One example of single-disc refiners is disclosed in WO publication 95/25199.

SUMMARY OF THE INVENTION

An object of the present invention is to provide a novel single-disc high-consistency wood chip refiner as well as a novel blade element for a rotatable disc-like refining element.

The single-disc refiner according to an invention is characterized in that the refining surfaces of the refining elements comprise, in a radial direction of the refining elements, a feed zone followed by a treatment zone, wherein a transition point from the feed zone to the treatment zone is located at a radial distance of 70-90% from the center of the refiner or at a radial distance of 50-80% from the innermost edge of the refining element or at a radial distance of 20-50% from the inner edge of the outer blade element toward the outermost edge of the refining element.

The radius of the refiner is the distance from the center of the refiner to the outer edge of a radially outermost blade element. In other words, the radius of the refiner is the distance from the center of the refiner to the outer circumference of the radially outermost blade element.

The radius of the refining element is the distance between the inner edge of a radially innermost blade element and the outer edge of a radially outermost blade element. In other words, the radius of the refining element is the distance between the inner circumference of the radially innermost blade element and the outer circumference of the radially outermost blade element.

The radius of the outer blade element is the distance between the inner edge and the outer edge of the outer blade element. In other words, the radius of the outer blade element is the distance between the inner circumference and the outer circumference of the outer blade element.

The blade element according to the invention is characterized in that the blade element is intended to provide at least a part of an outer refining surface area in the rotatable refining element comprising, in a radial direction of the refining element, an inner refining surface area followed by an outer refining surface area, and that the blade element comprises, in a direction from the inner edge of the blade element toward the outer edge of the blade element, a feed zone followed by a treatment zone, and that the treatment zone of the blade element is arranged to be located at a distance of about 20% to 100%, or alternatively at a distance of about 30% to 100%, or at a distance of about 40% to 100% of the distance between the inner edge of the blade element and the outer edge of the blade element.

The invention is based on the idea of arranging in a single-disc refiner treatment zones on the refining surfaces of the opposing refining elements close to the outer circumferences of the refining elements. This means that the treatment zone is arranged to be located closer to the outer circumference of the refining element or of the blade element than conventionally, i.e., in an area where the length of the treatment zone in the circumferential direction of the refining elements is longer. With a proper blade bar and blade groove design and with conventional running speeds, it is possible to provide refining conditions substantially similar to those of the double-disc refiners. This means, for example, that a lower energy consumption is achieved when compared to conventional single-disc high-consistency wood chip refiners.

According to an embodiment of the refiner, the treatment zone is arranged to be located at a distance of 50% to 100% of the radius of the refining element, or of 70% to 100% of the radius of the refiner, or of 20% to 100% of the radius of the outer blade element. Preferably, the treatment zone is arranged to be located at a distance of 60% to 100% of the radius of the refining element, or of 75% to 100% of the radius of the refiner, or of 30% to 100%, of the radius of the outer blade element.

According to an embodiment of the refiner, the treatment zones of the refining surfaces of the refining elements comprise, in the radial direction of the refining elements, a defibration zone followed by a refining zone.

According to an embodiment of the refiner, the defibration zone is arranged to be located at a distance of 60 to 90% of the radius of the refining element or, preferably, at a distance of 70 to 80% of the radius of the refining element, the rest up to 100% being a refining zone.

According to an embodiment of the refiner, the feed zone of the refining surface of the rotatable refining element comprises at least one feed bar extending toward the treatment zone for feeding lignocellulosic material to be fed to the refiner toward the treatment zones of the refining elements of the refiner.

According to an embodiment of the refiner, the height of the feed bar at the feed zone is arranged to decrease toward the outer circumference of the rotatable refining element.

According to an embodiment of the refiner, a blade gap between the opposite refining elements has a height defined as a distance between the bottoms of the blade grooves of the opposite refining elements and the feed bar is arranged to extend toward the stationary refining element over an imaginary center line halving the blade gap in the height direction of the blade gap.

According to an embodiment of the refiner, the maximum height of the feed bar at the feed zone of the rotatable refining element is 50-100%, preferably 60-95%, or more preferably 70-90%, of the height of the blade gap.

According to an embodiment of the refiner, the feed bar has a leading side directed toward the rotation direction of the rotatable refining element, the leading side having a lower edge at the bottom of the feed bar and an upper edge at the top of the feed bar, and the feed bar is tilted toward the rotation direction of the rotatable refining element in such a way that the upper edge of the feed bar extends farther toward the rotation direction of the rotatable refining element than the lower edge of the feed bar.

According to an embodiment of the refiner, the feed zone of the refining surface of the stationary refining element comprises at least one guide bar extending toward the treatment zone for guiding feed of the ligno-cellulosic material to be fed to the refiner toward the treatment zones of the refining elements of the refiner.

According to an embodiment of the refiner, the height of the guide bar at the feed zone is arranged to increase toward the outer circumference of the stationary refining element.

According to an embodiment of the blade element, the feed zone comprises at least one feed bar extending toward the outer edge of the blade element and the height of the feed bar at the feed zone is arranged to decrease toward the outer edge of the blade element.

According to an embodiment of the blade element, the treatment zone of the refining surface of the blade element comprises, in a direction from the inner edge toward the outer edge, a defibration zone followed by a refining zone.

According to an embodiment of the blade element, the feed bar has a leading side to be directed toward the rotation direction of the rotatable refining element, the leading side having a lower edge at the bottom of the feed bar and an upper edge at the top of the feed bar, and the feed bar is tilted toward the rotation direction of the rotatable refining element in such a way that the upper edge of the feed bar extends farther toward the rotation direction of the rotatable refining element than the lower edge of the feed bar.

According to an embodiment of the blade element, the blade element is a blade segment intended to provide a part of the outer refining surface area of the rotatable disc-like refining element.

BRIEF DESCRIPTION OF THE DRAWINGS

In the following the invention will be described in greater detail by means of preferred embodiments with reference to the accompanying drawings.

For the sake of clarity, the figures show some embodiments of the invention in a simplified manner. Like reference numerals identify like elements in the figures.

DESCRIPTION OF THE PREFERRED EMBODIMENTS

Figure 4:
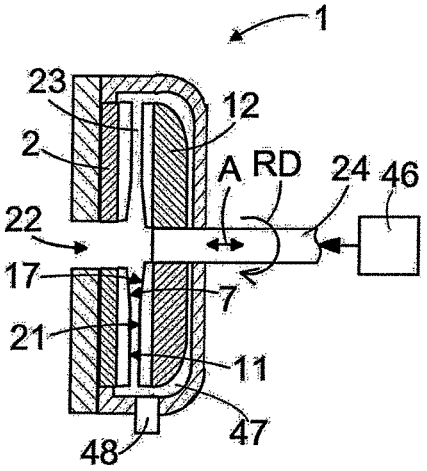
FIG. 4 is a schematic general side view of a single-disc high-consistency wood chip refiner in cross-section.

FIG. 4 shows schematically a general side view of a single-disc high-consistency wood chip refiner 1 in cross-section. The refiner 1 is used for refining wood chips for providing fibrous wood material suitable to be used for manufacturing paper or paperboard. The refiner 1 comprises a disc-like, or disk shaped, stationary refining element 2, i.e., a stator 2, and a disc-like, or disk shaped, rotatable refining element 12, i.e., a rotor 12, which are positioned coaxially opposite to each other. The stationary refining element 2 and the rotatable refining element 12 comprise blade elements having blade bars and blade grooves therebetween, the blade bars and the blade grooves providing radially inner 7 and outer 11 refining surfaces in the stationary refining element 2 and radially inner 17 and outer 21 refining surfaces in the rotatable refining element 12, for example. The rotatable refining element 12 is rotated by means of a shaft 24 in a manner known per se with a motor not shown for the sake of clarity, an exemplary rotation direction of the rotary refining element 12 being shown by an arrow RD. Further, FIG. 4 shows a loader 46 connected to affect the rotatable refining element 12 via the shaft 4 in such a way that it can be pushed toward the stationary refining element 2 or pulled away from the stationary refining element 2, as shown schematically by an arrow A, to adjust a blade gap 23, i.e., a refining gap 23, between them.

The lignocellulose-containing material to be refined is fed through a feed opening 22 in the middle of the stationary refining element 2 to the blade gap 23, where it is defibrated and refined at the same time as the water in the material vaporizes. The lignocellulose-containing material that has been defibrated and refined is discharged from the blade gap 23 through the outer edge of the blade gap 23 into a refiner chamber 47, from which it is further discharged out of the refiner 1 along a discharge channel 48.

The refining elements 2, 12 may be formed as annular discs or as separate pie-like segments. Depending on the diameter of the refiner 1, the blade elements may be formed radially continuous as shown in FIG. 4, but with larger diameters the refining elements 2, 12 may comprise radially inner and outer blade elements as shown in FIG. 1.

Figure 1:
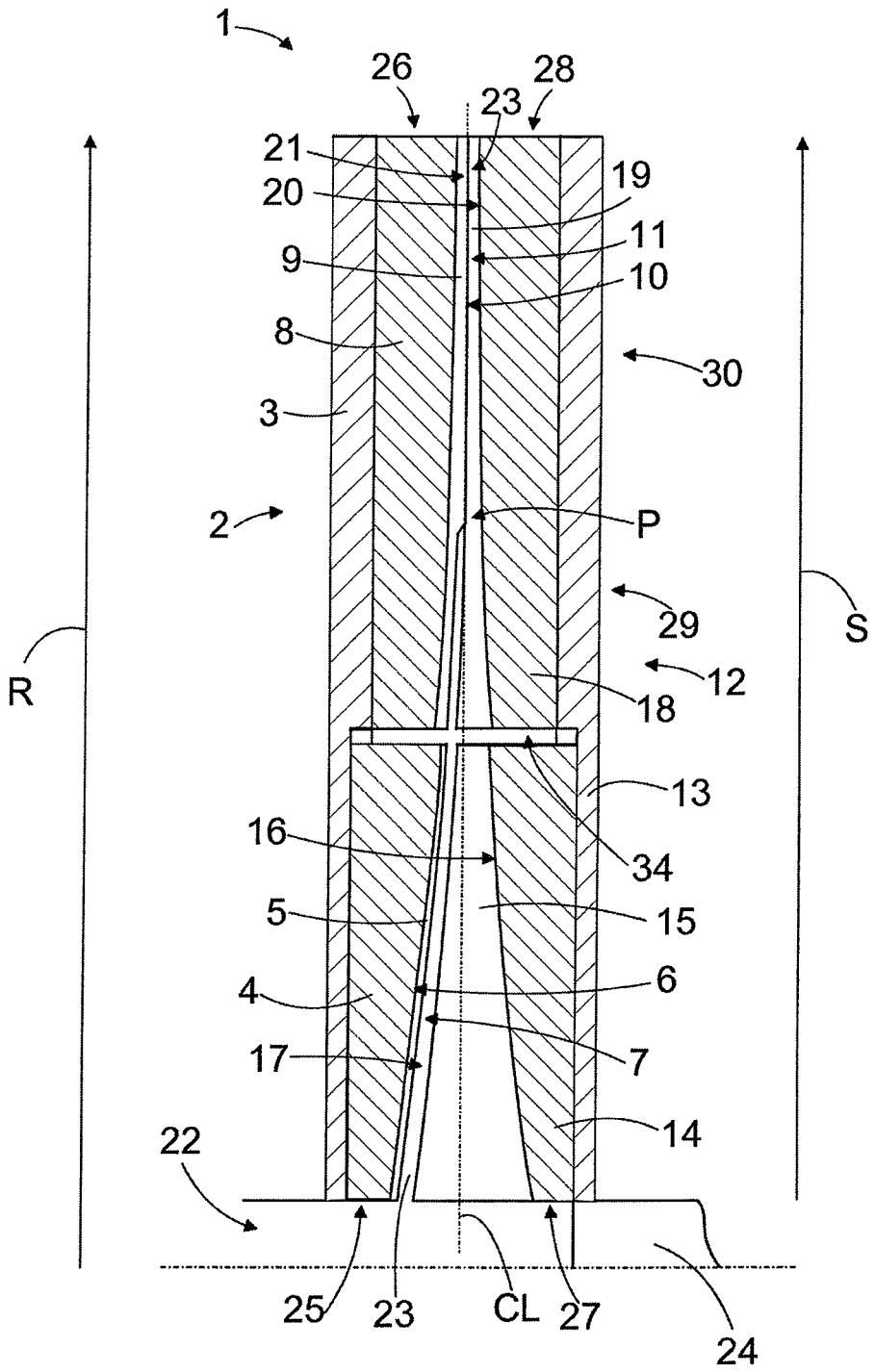
FIG. 1 is a schematic side view of a part of a single-disc high-consistency wood chip refiner in cross-section.

FIG. 1 is a schematic, more detailed side view of a single-disc high-consistency wood chip refiner 1. FIG. 1 only discloses the upper half of the refiner 1. The refiner 1 comprises a stationary refining element 2, which may also be called a stator 2. The stationary refining element 2 comprises a fastening body 3 and one or more first, radially inner, blade elements 4 attached to the fastening body 3 at the inner circumference of the stationary refining element 2 and one or more second, radially outer, blade elements 8 attached to the fastening body 3 at the outer circumference of the stationary refining element 2. The one or more first blade elements 4 comprise blade bars 5 and blade grooves 6 therebetween, the blade bars 5 and the blade grooves 6 providing a radially inner, first stator refining surface 7. The first stator refining surface 7 provides an annular inner refining surface of the stationary refining element 2. The one or more second blade elements 8 comprise blade bars 9 and blade grooves 10 therebetween, the blade bars 9 and the blade grooves 10 providing a radially outer, second stator refining surface 11. The second stator refining surface 11 provides an annular outer refining surface of the stationary refining element 2. The inner and outer refining surfaces 7, 11 of the stationary refining element 2 together provide a refining surface of the stationary refining element 2. The blade bars denoted with reference marks 5 and 9 in FIG. 1 form a guide bar the construction and purpose of which are discussed in more detail later. In addition to one or more guide bars, at least one of the first 4 and second 8 blade elements may also comprise conventional blade bars and blade grooves therebetween.

The refiner 1 further comprises a rotatable refining element 12, which may also be called a rotor 12, the rotatable refining element 12 being opposed to the stationary refining element 2 such that there is a small distance, i.e., a blade gap 23 or a refining gap 23, between them. The rotatable refining element 12 comprises a fastening body 13 and one or more first, radially inner, blade elements 14 attached to the fastening body 13 at the inner circumference of the stationary refining element 12 and one or more second, radially outer, blade elements 18 attached to the fastening body 13 at the outer circumference of the rotatable refining element 12. The one or more first blade elements 14 comprise blade bars 15 and blade grooves 16 therebetween, the blade bars 15 and the blade grooves 16 providing a radially inner, first rotor refining surface 17. The first rotor refining surface 17 provides an annular inner refining surface of the rotatable refining element 12. The one or more second blade elements 18 comprise blade bars 19 and blade grooves 20 therebetween, the blade bars 19 and the blade grooves 20 providing a radially outer, second rotor refining surface 21. The second rotor refining surface 21 provides an annular outer refining surface of the rotatable refining element 12. The inner and outer refining surfaces 16, 21 of the rotatable refining element 12 together provide a refining surface of the rotatable refining element 12. The blade bars denoted with reference marks 15 and 19 in FIG. 1 form a feed bar the construction and purpose of which are discussed in more detail later. In addition to one or more feed bars, at least one of the first 14 and second 18 blade elements may also comprise conventional blade bars and blade grooves therebetween.

At the center of the stationary refining element 2 there is a feed opening 22 through which a suspension of water and wood chips to be refined is fed into the blade gap 23 between the stationary refining element 2 and the rotatable refining element 12. Steam flow carrying fibres is discharged out of the refiner 1 in a consistency of 25-75%. The rotatable refining element 12 is connected through a shaft 24 to a rotating motor (not shown) to rotate the rotatable refining element 12 relative to the stationary refining element 2. When the rotatable refining element 12 rotates relative to the stationary refining element 2, wood chips fed into the blade gap 23 will be crushed, defibrated and refined and the refined fibrous wood material will move out of the blade gap 23 at the outer circumference of the stationary 2 and rotatable 12 refining elements.

The refining surfaces of the stationary refining element 2 and the rotatable refining element 12 comprise, starting from the innermost edges 25, 27, i.e., inner circumferences 25, 27, of the stationary 2 and rotatable 12 refining elements or the center of the refining elements 2, 12 and proceeding in the radial direction S of the refining elements 2, 12 toward the outermost edges 26, 28, i.e. outer circumferences 26, 28, of the stationary 2 and rotatable 12 refining elements, a number of successive refining surface zones having a varying effect on the material to be fed into the refiner 1. Starting from the inner circumferences 25, 27 of the refining elements 2, 12 and proceeding toward the outer circumferences 26, 28 of the refining elements 2, 12, there is a feed zone 29 followed by a treatment zone 30. The treatment zone 30 may be composed of only a defibration zone or there may be a defibration zone 31 (shown in FIG. 2) on the side of the feed zone 29 and a refining zone 32 (shown in FIG. 2) on the side of the outer circumferences 26, 28 of the refining elements 2, 12. The feed zone 29 is intended to supply the material to be refined toward the treatment zone 30, whereas the defibration zone 31 is intended to defibrate the material to be refined, and the refining zone 32 is intended to actually refine the material to be refined. Depending on the desired degree of refining, the treatment zone 30 may comprise only the defibration zone 31 or both the defibration zone 31 and the refining zone 32, the combination of the defibration zone 31 and the refining zone 32 providing a higher degree of refining.

In the example of FIG. 1, the feed zone 29 is arranged to extend to about 60-65% of the radial distance between the inner circumferences 25, 27 of the refining elements 2, 12 and the outer circumferences 26, 28 of the refining elements 2, 12 or, in other words, the feed zone 29 is arranged to be located at a radial distance of 0% to not more than 65% of the radius S of the refining elements 2, 12, i.e. the distance between the inner circumferences 25, 27 of the refining elements 2, 12 and the outer circumferences 26, 28 of the refining elements 2, 12, starting from the inner circumferences 25, 27 of the refining elements 2, 12 and extending toward the outer circumferences 26, 28 of the refining elements 2, 12. As a consequence, the treatment zone 30, in turn, is arranged to be located at a distance of about 60-100% of the radial distance between the inner circumferences 25, 27 of the refining elements 2, 12 and the outer circumferences 26, 28 of the refining elements 2, 12, starting from the inner circumferences 25, 27 of the refining elements 2, 12 and extending toward the outer circumferences 26, 28 of the refining elements 2, 12. The transition point from the feed zone 29 to the treatment zone 30 is denoted with a reference sign P, at which point there is an abrupt rise in height of the blade bar 9 in the second blade element 8 of the stationary refining element 2 toward the rotary refining element 12.

The transition point P is the point where the feed zone 29 ends and the treatment zone 30 begins and it is located at a radial distance of 70-90%, preferably 75-80%, from the center of the refiner 1 or at a radial distance of 50-80%, preferably 60-70%, from the innermost edge 25, 27 of the refining element 2, 12 or at a radial distance of 20-50%, preferably 30-40%, from the inner edge 34 of the outer blade element 8, 18, 33.

The radius of the refiner 1 is the distance from the center of the refiner 1 to the outer edge of a radially outermost blade element, and it is shown in FIG. 1 by an arrow R. In other words, the radius R of the refiner 1 is the distance from the center of the refiner 1 to the outer circumference of the radially outermost blade element.

The radius of the refining element, in turn, is the distance between the inner edge of a radially innermost blade element and the outer edge of a radially outermost blade element, and it is shown in FIG. 1 by an arrow S. In other words, the radius S of the refining element is the distance between the inner circumference of the radially innermost blade element and the outer circumference of the radially outermost blade element.

Figure 2:
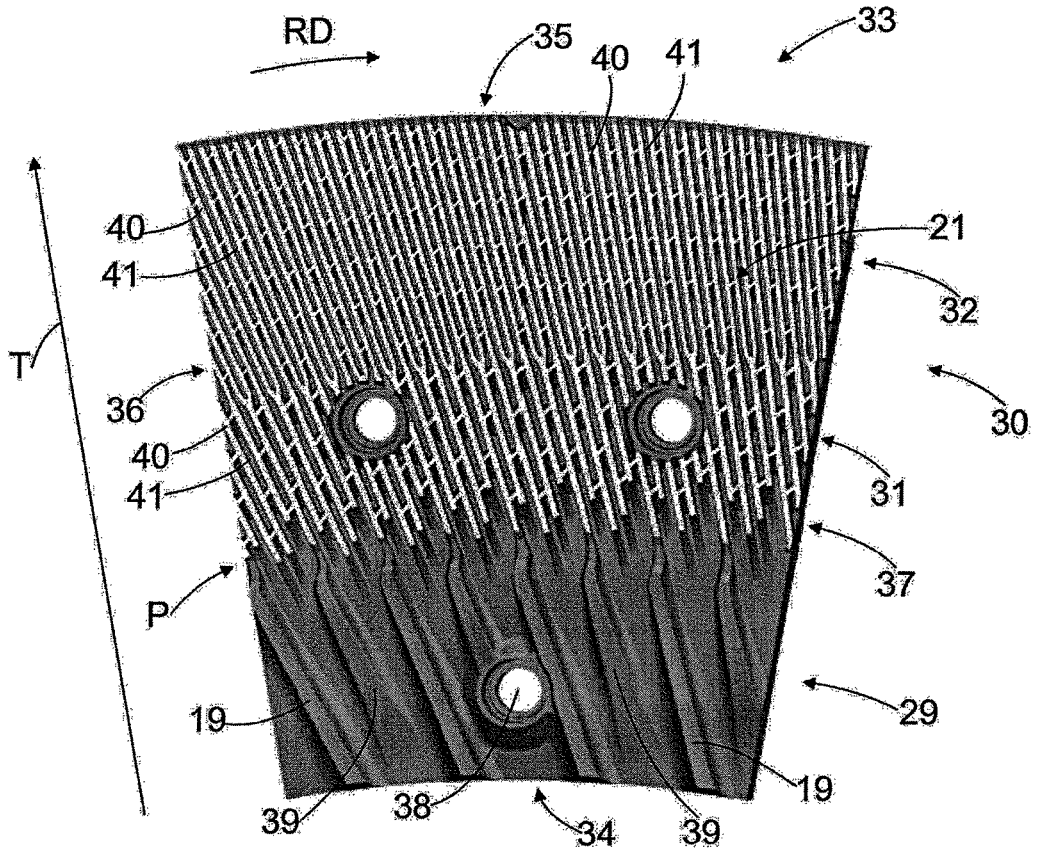
FIG. 2 is a schematic view of a blade element as seen in the direction of the refining surface of the blade element.

The radius of the outer blade element is the distance between the inner edge and the outer edge of the outer blade element. It is shown in FIG. 2 by an arrow T. In other words, the radius T of the outer blade element is the distance between the inner circumference and the outer circumference of the outer blade element.

FIG. 1 discloses only one example of an embodiment of the single-disc high-consistency wood chip refiner according to the solution disclosed herein. Generally, in the single-disc high-consistency wood chip refiner according to the solution disclosed herein, the treatment zone 30 in the refining elements 2, 12 is arranged to be located at a distance of about 70% to 100%, preferably 75% to 100%, of the radius R of the refiner 1, starting from the center of the refiner 1 and extending toward the outer circumferences 26, 28 of the refining elements 2, 12. Alternatively, the treatment zone 30 is arranged to be located at a distance of about 50% to 100%, preferably 60% to 100%, of the radius S of the refining elements 2, 12, from the inner edges 25, 27 of the refining elements 2, 12, or at a distance of about 20% to 100%, preferably from 30% to 100%, of the radius T of the outer blade elements 8, 18, from the inner edge 34 of the outer blade elements 8, 18.

In the refiner disclosed above, the treatment zone 30 is arranged to be located substantially closer to the outer circumferences 26, 28 of the refining elements 2, 12 than in conventional single-disc high-consistency wood chip refiners, and the feed zone 29 is thus arranged to extend, in the radial direction of the refining elements 2, 12, farther toward the outer circumferences 26, 28 of the refining elements 2, 12 than in conventional single-disc high-consistency wood chip refiners. This means that the treatment zone 30 is arranged to be located in an area where the length of the treatment zone 30 in the circumferential direction of the refining elements 2, 12 is longer, i.e. in the area where, with a proper blade bar and blade groove design and with conventional running speeds of the rotatable refining element 12 of the single-disc high-consistency wood chip refiners, it is possible to provide refining conditions, such as a number of impacts provided by the blade bars of the refining elements 2, 12 to the material to be refined, so that a refining effect substantially similar to a refining effect provided by double-disc refiners may be achieved. This means that the present advantages of double-disc refiners over conventional single-disc high-consistency wood chip refiners, such as a high loading capacity, a high degree of refining and a lower energy consumption may also be achieved by a single-disc high-consistency wood chip refiner.

Referring to the above, a typical diameter of a blade element in a single-disc high-consistency wood chip refiner and in a double-disc high-consistency wood chip refiner is about 68 inches, or about 173 centimeters. In conventional double-disc refiners, defibration of the material to be refined takes place at a distance of about 60 centimeters of the radius of the refining element. If the rotating frequency of both opposing refining elements (both refining elements are arranged to rotate) is 1500 rpm, the angular speed at that distance from the center of the refining elements is 2 times 1500 rpm=50 r/s, which means a circumferential speed of about 2Pi×0.6 m x50 r/s=188.5 m/s. If the distance of leading edges of neighboring blade bars is 14 millimeters, the impact frequency, i.e. the number of impacts provided by the blade bars of the refining elements 2, 12 to the material to be refined, is about 13,460 Hz.

In conventional single-disc refiners, defibration of the material to be refined takes place at a distance of about 40 centimeters of the radius of the refining element. When the rotating frequency of the rotatable refining element is 1500 rpm, the circumferential speed at that distance from the center of the refining element is only about 63 m/s. This circumferential speed is much too low in order to achieve the refining conditions of a double-disc refiner in conventional single-disc refiners, because in practice it is not possible to provide such a blade bar and blade groove combination that would operate properly without becoming clogged with the material to be refined.

However, in the single-disc high-consistency wood chip refiner disclosed herein, when the defibration of the material to be refined is arranged to take place, for example, at a distance of about 70 centimeters of the radius of the refiner, i.e. at a distance of about 80% of the radius of the refiner, the circumferential speed at that distance from the center of the refiner is about 110 m/s. If the distance of the leading edges of neighbouring blade bars is 8 millimeters, the impact frequency, i.e. the number of impacts provided by the blade bars of the refining elements 2, 12 to the material to be refined, is about 13,740 Hz, i.e. the same as in conventional double-disc refiners. This means that the refining conditions similar to those of double-disc refiners may be achieved with the single-disc refiner according to the solution described herein, whereby the present advantages of double-disc refiners over conventional single-disc high-consistency wood chip refiners, such as a high loading capacity, a high degree of refining and a lower energy consumption may also be achieved by a single-disc high-consistency wood chip refiner disclosed above.

Below is a table representing a comparison made with a known conventional single-disc high-consistency wood chip refiner indicated with SD_C and a known conventional double-disc high-consistency wood chip refiner indicated with DD_C versus a single-disc high-consistency wood chip refiner according to the solution disclosed herein and indicated with SD_I. The known conventional refiner types were a 2-stage single-disc refiner SD 65/68 and a 1-stage double-disc refiner RGP 68 DD (both available from Valmet Corporation, Espoo, Finland). Pulp properties at a constant freeness level of 85 ml were analyzed.

| | SD_C | DD_C | SD_I |
|---|---|---|---|
| Total energy consumption [kWh/air dry metric ton] | 2250 | 1900 | 1850 |
| Freeness CSF [ml] | 85 | 85 | 85 |
| Fibre length [mm] | 1.5 | 1.35 | 1.2 |
| Light scattering [$m^2$/kg] | 52.5 | 57 | 56 |

The results show that, with the refiner according to the solution described, good optical properties close to the level of DD_C refined pulp and a clear improvement over the SD_C refined pulp may be achieved. Still, the fibre length loss compared to DD_C refined pulp is minor whereby the mechanical properties of the pulp are maintained on a sufficient level. Energy consumption is also 20% smaller compared to a conventional SD_C refiner, being about on the same level as in DD_C refiner or even below it.

As shortly mentioned above, the treatment zone 30 may be composed of only the defibration zone 31 or, alternatively, the treatment zone 30 may comprise, in the radial direction S of the refining elements 2, 12, the defibration zone 31 followed by the refining zone 32. In the latter case, the defibration zone is arranged to be located at a distance of about 60-90% of the radius S of the refining elements 2, 12, starting from the center of the refining elements 2, 12 or, preferably, at a distance of about 70-80% of the radius S of the refining elements 2, 12 from the center of the refining elements 2, 12.

In the refiner 1 disclosed, the feed zone 29 of the rotatable refining element 12 comprises at least one, preferably more, feed bars 15, 19 extending toward the treatment zone 30 for feeding wood chips to be fed to the refiner 1 toward the treatment zones 30 of the refining elements 2, 12 of the refiner 1. The feed bars 15 and 19 extend in a direction from the inner circumference 27 of the rotatable refining element 12 toward the outer circumference 28 of the rotatable refining element 12, i.e. toward the treatment zone 30 of the rotatable refining element 12, and they may be aligned in the circumferential direction of the rotatable refining element 12 in such a way that the feed bar 15 in the first blade element 14 continues as the feed bar 19 in the second blade element 18. The heights of the feed bars 15, 19 at the feed zone 29 of the rotatable refining element 12 are arranged to decrease toward the outer circumference 28 of the rotatable refining element 12. The substantially great height of the feed bars 15, 19 on the side of the inner circumference 27 of the rotatable refining element 12 provides an effective feed of wood chips from the feed opening 22 toward the treatment zone 30. The height of the feed bars 19 on the annular outer refining surface of the rotatable refining element 12 will eventually decrease to a height corresponding to the height of conventional blade bars at the treatment zone 30, which can be seen more clearly in FIG. 2.

The height of the feed bars 15, 19 at the feed zone 29 may be dimensioned in such a way that in a common cross-section of the stationary refining element 2 and the opposed rotatable refining element 12, which cross-section is in a direction crosswise to the radial direction of the refining elements, i.e. in the direction of the shaft 24 of the refiner 1, the feed bars 15, 19 of the rotatable refining element 12 are arranged to extend toward the stationary refining element 2 over an imaginary center line of the common cross-section of the stationary refining element 2 and the opposed rotatable refining element 12, the imaginary center line being denoted with a reference sign CL in FIG. 1. The center line CL is a radial line which halves the blade gap 23 between the opposite refining elements 2, 12 in the height direction of the blade gap 23, the blade gap height being defined as a distance of blade groove 6, 16 bottoms of the opposite refining elements 2, 12 on the same radial level. As seen in FIG. 1, the blade gap height is not uniform, but somewhat conical, and is wider at the inner circumferences 25, 27 of the refining elements 2, 12 and closes toward zero before the outer circumferences 26, 28 of the refining elements 2, 12, where the blade bars of the opposite refining elements 2, 12 almost touch each other. The feed bars 15, 19 of the rotatable refining element 12 extend toward the stationary refining element 2 over the imaginary center line CL in such a way that the maximum height of the feed bar 15, 19 at the feed zone 29 of the rotatable second refining element 12 is 50-100%, preferably 60-95%, or more preferably 70-90%, of the height of the blade gap 23. The greater height of the feed bars 15, 19 on the side of the inner circumference of the rotatable refining element 12 will supply the wood chips effectively from the feed opening 22 toward the treatment zone 30, but the height of the feed bars 19 at the annular outer refining surface of the rotatable refining element 12 decrease to a height corresponding to the height of conventional blade bars at the treatment zone 30.

In the refiner 1 disclosed, the feed zone 29 of the stationary refining element 2 comprises at least one, preferably more, guide bars 5, 9 extending toward the treatment zone 30 for guiding the feed of wood chips to be fed to the refiner 1 toward the treatment zones 30 of the refining elements 2, 12 of the refiner 1. The guide bars 5 and 9 extend in a direction from the inner circumference of the stationary refining element 2 toward the outer circumference of the stationary refining element 2, and they may be aligned in the circumferential direction of the stationary refining element 2 in such a way that the guide bar 5 in the first blade element 4 continues as the guide bar 9 in the second blade element 9. The heights of the guide bars 5, 9 at the feed zone of the stationary refining element 2 are arranged to increase toward the outer circumference 26 of the stationary refining element 2 with a measure corresponding to the decrease of heights of the feed bars 15, 19 in the rotatable refining element 12.

FIG. 2 is a schematic view of a blade element 33 for providing a part of the annular outer refining surface of the rotatable refining element 12. The blade element 33 has an inner edge 34, i.e. an inner circumference 34, to be directed toward the inner circumference 27 of the rotatable refining element 12, and an outer edge, i.e. an outer circumference 35, to be directed toward the outer circumference 28 of the rotatable refining element 12, as well as side edges 36, 37. The blade element 33 is fastened to the fastening body 13 with bolts, for example, inserted through fastening holes 38. Other fastening means are also possible, such as segment holders, when there are no holes on the blade surface.

The blade element 33 of FIG. 2 comprises, in the direction from the inner circumference 34 of the blade element 33 toward the outer circumference 35 of the blade element 33 or in the radial direction T of the blade element 33, a feed zone 29 followed by a treatment zone 30 comprising a defibration zone 31 and a refining zone 32. The feed zone 29 of the blade element 33 comprises feed bars 19, the height of which is arranged to decrease toward the outer circumference 35 of the blade element 33. The feed zone 29 of the blade element 33 may also comprise auxiliary blade bars 39, which may even out the flow of material at the feed zone 29. The defibration zone 31 and the refining zone 32 comprise conventional blade bars 40 and conventional blade grooves 41 therebetween. In the defibration zone 31 the blade bar 40 and blade groove 41 layout is substantially sparse to allow the blade bars of the opposite blade elements to defibrate wood chips effectively, whereas in the refining zone 32 the blade bar 40 and blade groove 41 layout is substantially dense to allow the blade bars of the opposite blade elements to refine the material defibrated in the defibration zone 31 effectively.

In the blade element 33 disclosed above and intended to provide a part of the annular outer refining surface of the rotatable refining element 12, the feed zone 29 is arranged to extend from the inner circumference 34 of the blade element 33 toward the outer circumference 35 of the blade element 33 to a maximum distance of about 40% or, alternatively, to a distance of about 30% or about 20% of the distance between the inner circumference 34 of the blade element 33 and the outer circumference 35 of the blade element 33, i.e. of the radius T of the blade element 33. In other words, the treatment zone 30 of the blade element 33 is arranged to be located at a distance of about 20% to 100% or, alternatively, at a distance of about 30% to 100% or at a distance of from about 40% to 100% of the distance between the inner circumference 34 of the blade element 33 and the outer circumference 35 of the blade element 33.

In the embodiment of FIG. 2, the feed zone 29 may thus cover the first 0-40% of the radius T of the outer blade element. The treatment zone 30 may cover 20-100% of the radius T. The defibration zone 31 may extend from a minimum distance of 20% of the length of the radius T up to the outer edge 35 of the outer blade element, thus covering 20-100% of the radius T, or alternatively from about 20% to about 50-80% of the radius T, in which case the refining zone 32 covers the rest of the distance to the outer edge 35. In a preferred embodiment, the radial coverage is in the range of 0-35% for the feed zone 29, 30-60% for the defibration zone 31, and 50-100% for the refining zone 32.

The blade element disclosed in FIG. 2 is a blade segment intended to provide a part of the annular outer refining surface of the rotatable refining element 12, whereby the whole annular outer refining surface of the rotatable refining element 12 is provided by placing several blade segments of FIG. 2 next to each other. Alternatively, a single annular blade element extending over the whole circumference of the rotatable refining element 12 may also be used to provide the whole annular outer refining surface of the rotatable refining element 12. The inner and outer refining surfaces of the stationary refining element 2 as well as the inner refining surface of the rotatable refining element 12 may also be formed of a number of blade segments placed next to each other or of a single annular blade element extending over the whole circumference of the stationary 2 or rotatable 12 refining element.

Figure 3:
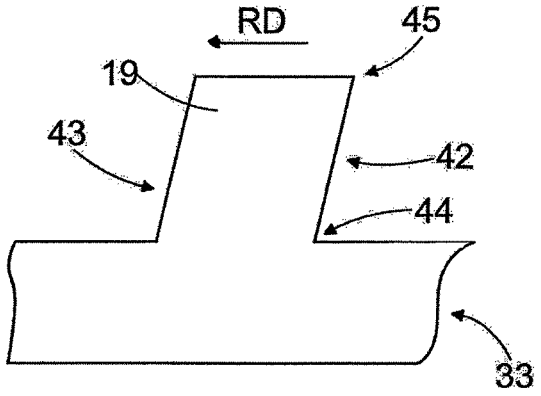
FIG. 3 is a schematic end view of a feed bar.

FIG. 3 is a schematic end view of the feed bar 19 in the feed zone 29. In FIG. 3 the intended rotation direction of the rotatable refining element is denoted with an arrow RD. The feed bar has a leading side 42 directed toward the rotation direction RD of the rotatable refining element 12 and a tailing side 43 directed to a direction opposite to the rotation direction RD of the rotatable refining element 12. The leading side 42 has a lower edge 44 at the bottom of the feed bar 19 and an upper edge 45 at the top of the feed bar 19. The feed bar 19 is tilted toward the rotation direction RD of the rotatable refining element 12 in such a way that the upper edge 45 of the feed bar 19 extends farther toward the rotation direction RD of the rotatable refining element 12 than the lower edge 44 of the feed bar 19. The tilting of the feed bar 19 toward the rotation direction RD of the rotatable refining element 12 prevents the wood chips to be fed into the refiner 1 from rising to the top of the feed bars 19, thereby preventing the wood chips from entering between the opposing refining elements and starting to defibrate before they enter to the actual treatment zone 30.

Although the present solution is described in connection with wood chip refiners, it is clear for the person skilled in the art that the invention is applicable for fibre refining as well, such as further refining of reject fibers.

It will be obvious to a person skilled in the art that, as technology advances, the inventive concept can be implemented in various ways. The invention and its embodiments are not limited to the examples described above but may vary within the scope of the claims.

We claim:

1. A single-disc refiner for refining lignocellulosic material of 25-75% consistency for paper and board manufacturing, comprising:

a stationary refining element and an opposed rotatable refining element, the rotatable refining element having an axis about which it rotates which defines a center of the refiner, and a radial direction extending radially from the axis, an axial direction being defined by the axis;

wherein the stationary refining element has at least one radially extending stationary blade element having stationary guide bars and grooves therebetween, which stationary guide bars and grooves extend from an innermost edge of the stationary refining element closest to the axis, which guide bars and grooves are followed in the radial direction after a transition point by a defibration zone which is followed by a refining zone extending to an outermost edge furthest from the axis;

wherein the stationary refining element and the rotatable refining element define a feed zone radially inwardly of the transition point;

wherein the rotatable refining element has at least one radially extending blade element having rotatable feed bars and grooves therebetween, which extend from an innermost edge closest to the axis, wherein the feed bars and grooves are followed in the radial direction after the transition point by a defibration zone followed by a refining zone extending to an outermost edge furthest from the axis;

wherein the stationary refining element and the opposed rotatable refining element form a blade gap therebetween, wherein the rotatable refining element feed grooves have bottoms, and the stationary refining element guide grooves have bottoms, and the blade gap having a height defined as a distance, in the axial direction, between the rotatable refining element groove bottoms and the stationary refining element groove bottoms of the opposed refining elements at a selected radial distance in the radial direction;

wherein the rotatable refining element feed bars extend toward the stationary refining element over an imaginary center line halving the blade gap in the height direction of the blade gap, wherein the rotatable refining element feed bars extend over the imaginary center line continuously from the innermost edge closest to the axis to substantially the transition point;

wherein at the transition point, the stationary refining element guide bars form an abrupt rise in height toward the rotatable refining element and at the transition point there is an abrupt decrease in height of the rotatable refining element feed bars;

wherein a first radial length is defined from the axis to the outermost edge in the radial direction of the stationary refining element and the opposed rotatable refining element;

wherein a second radial length is defined in the radial direction from the innermost edge of the stationary refining element and the opposed rotatable refining element to the outermost edge of the stationary refining element and the opposed rotatable refining element in the radial direction;

wherein the transition point is located on the stationary refining element and the opposed rotatable refining element at a radial distance of 75-80% of the first radial length and said transition point is also located at a radial distance of 60-70% of the second radial length.

2. The refiner of claim 1 wherein the feed zone is defined from the innermost edge of the at least one radially extending blade element of the stationary refining element and the opposed rotatable refining element to the transition point, and wherein the feed bars in the feed zone of the rotatable refining element extend to a maximum height in the height direction of the blade gap which is 60-95% of the height of the blade gap.

3. The refiner of claim 2 wherein the maximum height of the feed bars in the feed zone of the rotatable refining element is 70-90%, of the height of the blade gap.

4. The refiner of claim 1 wherein the defibration zone is located at a radial distance from the axis of 75-90% of the first radial length from the axis in the radial direction with a remaining portion of the first radial length from the axis in the radial direction to the outermost edge of the rotatable refining element further in the radial direction forming the refining zone.

5. The refiner of claim 4 wherein the defibration zone is located at a radial distance of 75-80% of a length from the axis in the radial direction to the outermost edge of the outer blade element with a remaining portion of the first length from the axis in the radial direction to the outermost edge of the outer blade element further in the radial direction forming the refining zone.

6. The refiner of claim 1 wherein the rotatable refining element has a rotation direction and the feed bars each have a leading side directed toward the rotation direction, the leading side having a lower edge where the feed bar joins the rotatable refining element and an upper edge at an uppermost portion of the feed bar in the height direction, and the feed bars are tilted toward the rotation direction of the rotatable refining element in such a way that the upper edges of the feed bars extend farther toward the rotation direction of the rotatable refining element than the lower edges of the feed bars.

* * * * *